US009132946B2

(12) United States Patent
Sze

(10) Patent No.: US 9,132,946 B2
(45) Date of Patent: Sep. 15, 2015

(54) TWIST VACUUM-SEALED CONTAINER

(75) Inventor: Wai Po Sze, Kowloon (CN)

(73) Assignee: ALS PLASTICS INDUSTRY COMPANY LIMITED, Hong Kong (HK)

( * ) Notice: Subject to any disclaimer, the term of this patent is extended or adjusted under 35 U.S.C. 154(b) by 434 days.

(21) Appl. No.: 13/563,348

(22) Filed: Jul. 31, 2012

(65) Prior Publication Data

US 2013/0037540 A1 Feb. 14, 2013

(30) Foreign Application Priority Data

Aug. 11, 2011 (CN) ..... 2011 2 0294157

(51) Int. Cl.

*B65D 43/04* (2006.01)
*B65D 51/18* (2006.01)
*B65D 43/02* (2006.01)

(52) U.S. Cl.

CPC ..... *B65D 51/18* (2013.01); *B65D 43/022* (2013.01); *B65D 2251/009* (2013.01); *B65D 2251/0018* (2013.01); *B65D 2543/00194* (2013.01); *B65D 2543/00231* (2013.01); *B65D 2543/00518* (2013.01); *B65D 2543/00546* (2013.01); *B65D 2543/00824* (2013.01); *B65D 2543/00972* (2013.01)

(58) Field of Classification Search

CPC ..... B65D 43/022; B65D 51/18; B65D 2543/00231
USPC ..... 220/803, 804, 237, 234, 378, 235, 236, 220/238, 233; 215/359, 360, 361, 358
See application file for complete search history.

(56) References Cited

U.S. PATENT DOCUMENTS 2,096,358 A * 10/1937 Gautier ..... 220/580
6,513,549 B2 * 2/2003 Chen ..... 138/89
2012/0305558 A1 * 12/2012 Steininger ..... 220/235

* cited by examiner

*Primary Examiner* — Jeffrey Allen

(57) ABSTRACT

A rotary airtight container having a body, a lid that covers the opening of the body, a cover plate connected to the underside of the lid, a lifting mechanism for driving the cover plate to move with respect to the lid, a circumferential cone-shaped seal ring positioned all around the lid, and a tapered annular interface that on the bottom of the lid and engages the seal ring. As the lifting mechanism drives the cover plate to lift relative to the lid, the cone-shaped seal ring lifts relative to the lid and moves upwards along the tapered annular interface to seal the space between the tapered annular interface and the opening of the container, thus isolating the inside of the container from outside. This container changes the ordinary way of sealing that uses a locking nut for tightly pressing on the opening of the container, and is easier to operate.

8 Claims, 8 Drawing Sheets

TWIST VACUUM-SEALED CONTAINER

TECHNICAL FIELD

The present invention relates to an airtight container, more particularly, relates to a twist, vacuum-sealed, airtight container.

BACKGROUND

Airtight container is a very common article for daily use, always used for cutting off ambient air from articles such as foods, biscuits, batteries etc. to keep them from moisture. Usually, a rotary airtight container has a body, a cover threadly connected with the body, an air grommet washer provided on the opening of the body to realize the isolation of air from the inside of the container. In order to work well, this kind of airtight container needs the cover to be tightly engaged with the body, but it is not easy to operate, and if a user wants to take out the articles from the container, it is also very hard to open the cover.

SUMMARY

In order to overcome the inconvenience of operation of the airtight container of the prior art, one purpose of the present invention is to provide an airtight container in rotary motion, the lifting mechanism on the lid can lift the cone-shaped seal ring between the opening and the lid of the container, thus making it easy to seal the container.

The rotary airtight container according to the present invention comprises: a body; a lid that covers the opening of the body; a cover plate connected to the lid under the lid; a lifting mechanism for driving the cover plate to move with respect to the lid; a cone-shaped seal ring positioned all around the lid; and a tapered annular interface on the bottom of the lid and engages the seal ring.

Preferably, said lifting mechanism comprises a lift rod rotatably provided on the lid, a twist grip fixed on the top portion of the lift rod, the lower end of the lift rod being rotatably connected with the cover plate; at least two location notches with different depth that matches with the twist grip are provided on the lid.

Preferably, said lifting mechanism comprises a swivel nut for engaging with the cover plate to drive the cover plate to lift, and a locking cover for locating the swivel nut on the cover plate.

Preferably, a cartridge that extends upwards is provided at the center of the cover plate, a slot being provided at the center of the lid for the cartridge passing through, the swivel nut being sleeved on the cartridge; a first spiral slideway and a first sliding column for driving the lid to lift is provided between the outer wall of the cartridge and the inner wall of the swivel nut, and a second spiral slideway and a second sliding column for driving the lid to move down is provide thereon.

Preferably, said first spiral slideway and second sliding column are located on the inner wall of the swivel nut; said second spiral slideway and first sliding column are located on the outer wall of the cartridge.

Preferably, a first quit gap is provided on the first slideway of the swivel nut for disconnection of the first sliding column.

Preferably, a second quit gap is provided on the slot of the lid for disconnection of the first sliding column.

Preferably, a third positioning step is provided on the lid for engaging with the lower end of the swivel nut, a positioning sleeve being provided at the inner side of the slot on the center of the lid, a first positioning step and second positioning step being provided between the locking cover and the swivel nut to prevent horizontal relative movement of themselves; a positioning jack catch that inserts into the poisoning sleeve and locked on the lower end surface of the sleeve is provided on the bottom of the locking cover.

Preferably, a positioning column and a positioning gap are provided between the first positioning step and second positioning step for preventing relative rotation of the locking cover and the swivel nut.

Preferably, a positioning sleeve is provided on the center of the lid, the swivel nut is sleeved outside the positioning sleeve, a first positioning step and second positioning step being provided between the locking cover and the swivel nut to prevent horizontal relative movement of themselves; a positioning jack catch that inserts into the poisoning sleeve and locked on the lower end surface of the sleeve is provided on the bottom of the locking cover.

The benefits of the airtight container as in present invention are, the lifting mechanism drives the cover plate to lift relative to the lid, to make the cone-shaped seal ring lifts relative to the lid; when the cone-shaped seal ring move upwards along the tapered annular interface, it is pressed into the vacant space between the tapered annular interface and the opening of the container, thus isolating the inside of the container from outside; as the cover plate is driven by the lifting mechanism, it changes the ordinary way of sealing that uses a locking nut for tightly pressing on the opening of the container, and is easier to operate.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
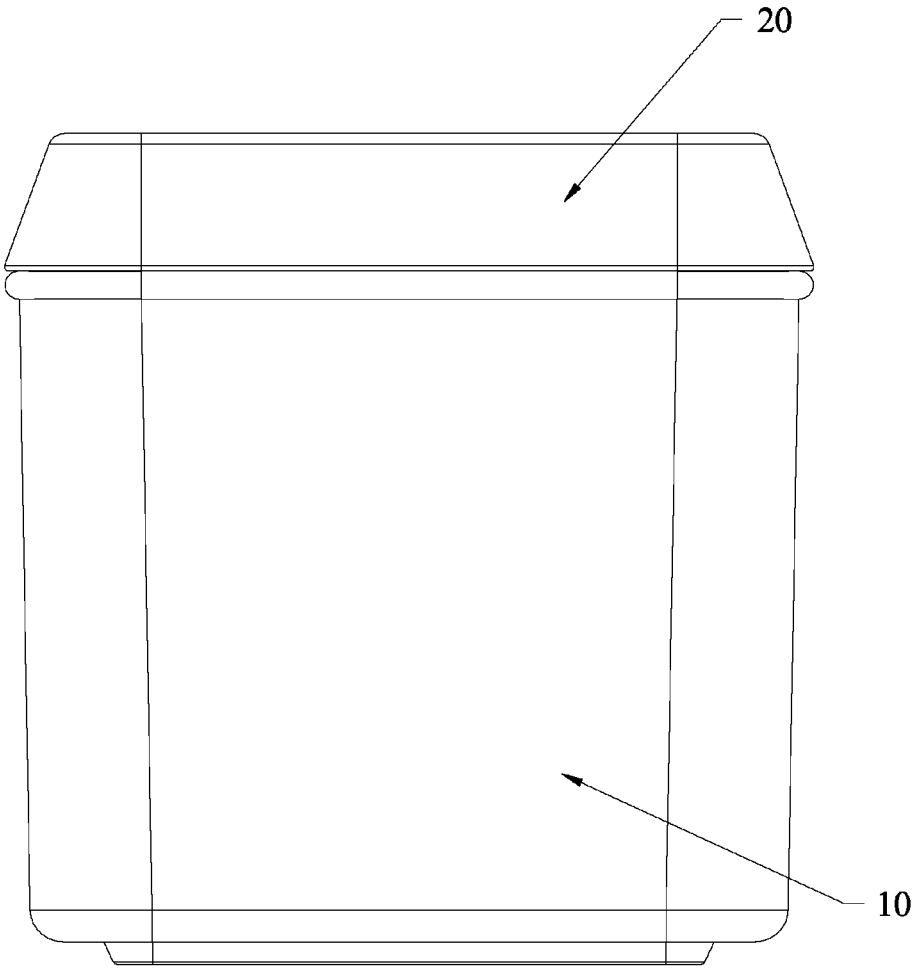
FIG. 1 is a perspective view of the airtight container as provided in the present invention.
Figure 1A:
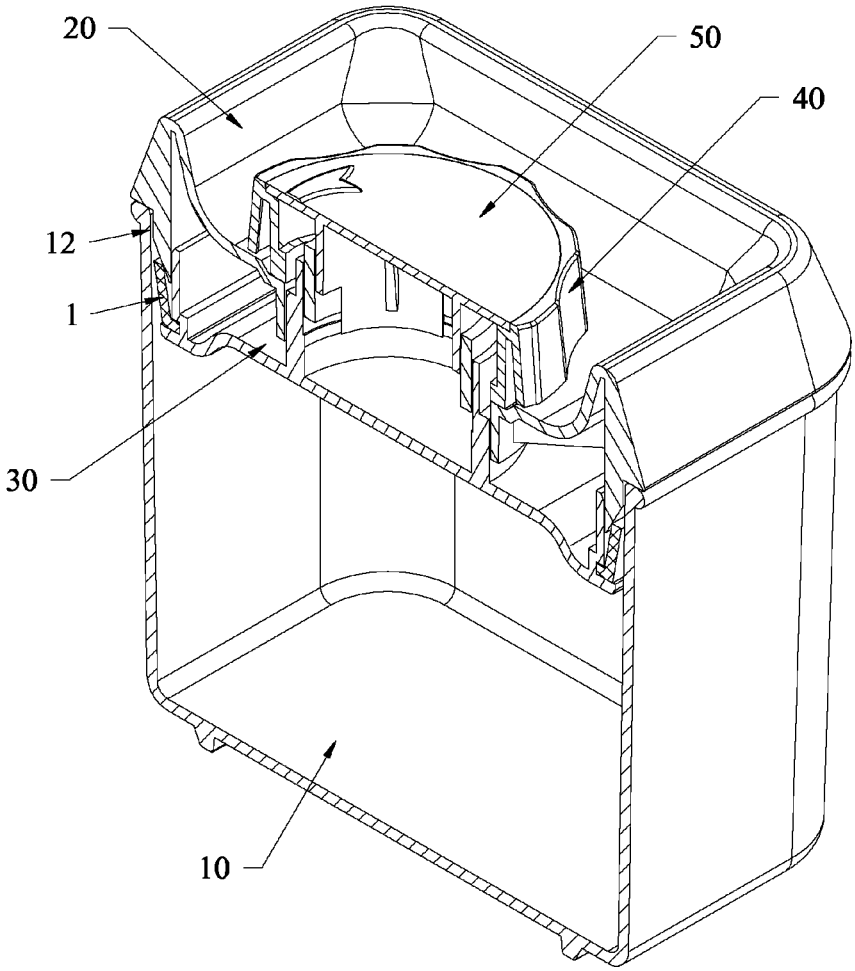
FIG. 1*a* is a perspective section view of the container as provided in the present invention.
Figure 1B:
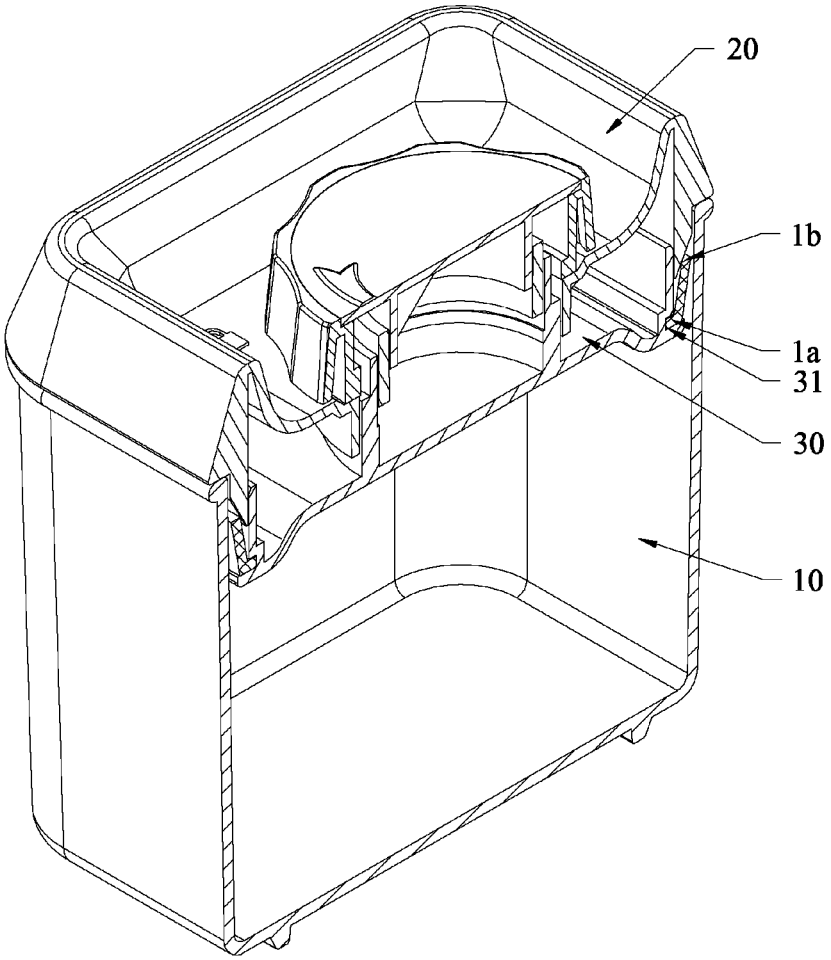
FIG. 1*b* is a perspective section view of the container in another direction in the present invention.
Figure 2:
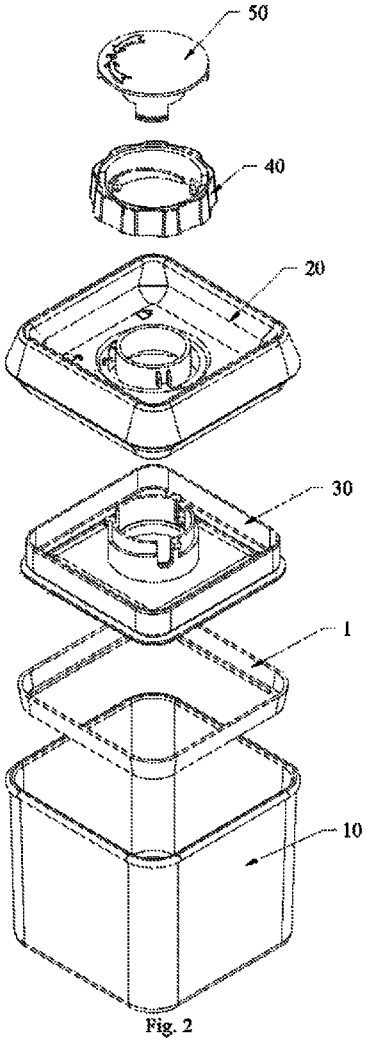
FIG. 2 is an exploded view of the container as provided in the present invention.
Figure 3:
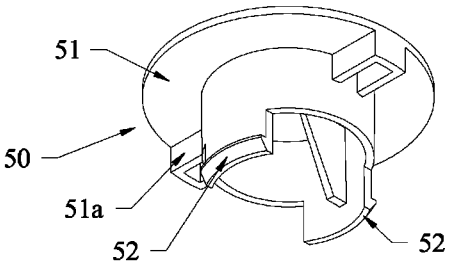
FIG. 3 is a perspective view of the locking cover of the container as provided in the present invention.
Figure 4A:
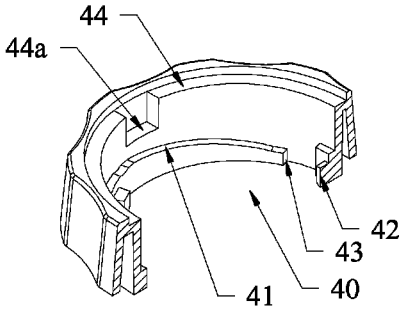
FIG. 4*a* is a perspective section view of the swivel nut of the container as provided in the present invention.
Figure 4B:
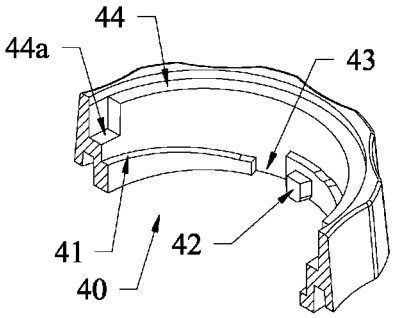
FIG. 4*b* is another perspective section view of the swivel nut as provided in the present invention.
Figure 5:
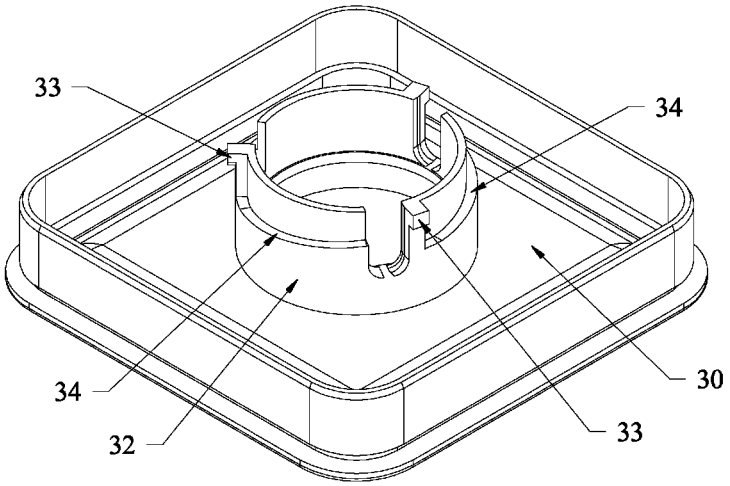
FIG. 5 is a perspective view of the cover plate of the container as provided in the present invention.
Figure 5A:
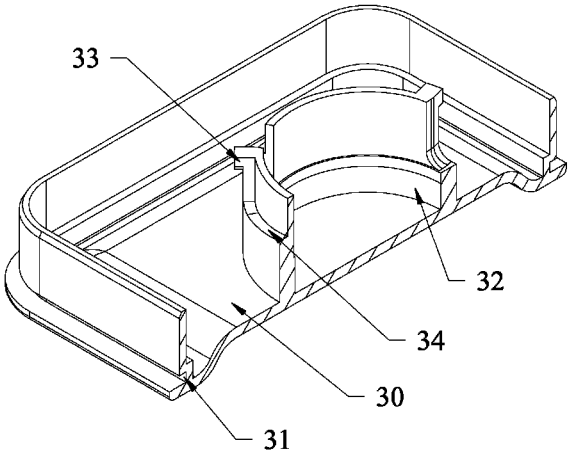
FIG. 5*a* is a perspective section view of the cover plate of the container as provided in the present invention.
Figure 6:
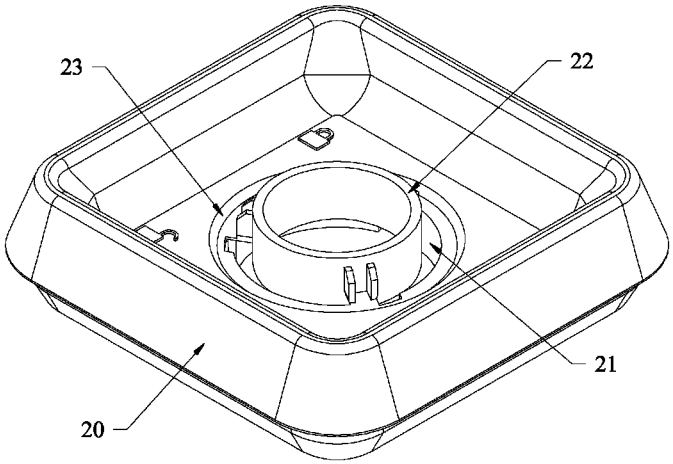
FIG. 6 is a perspective view of the lid of the container as provided in the present invention.
Figure 6A:
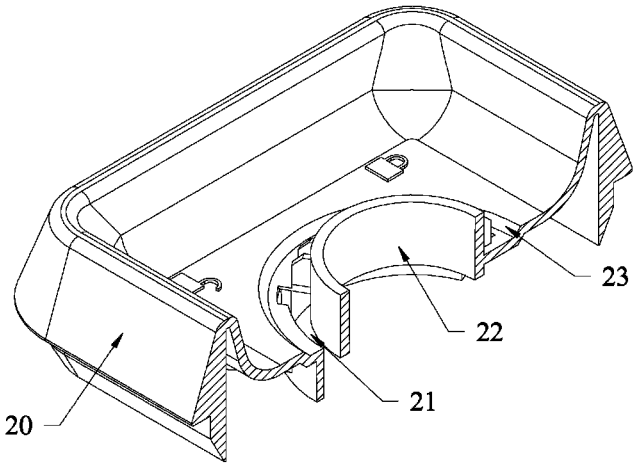
FIG. 6*a* is a perspective section view of the lid of the container as provided in the present invention.
Figure 7:
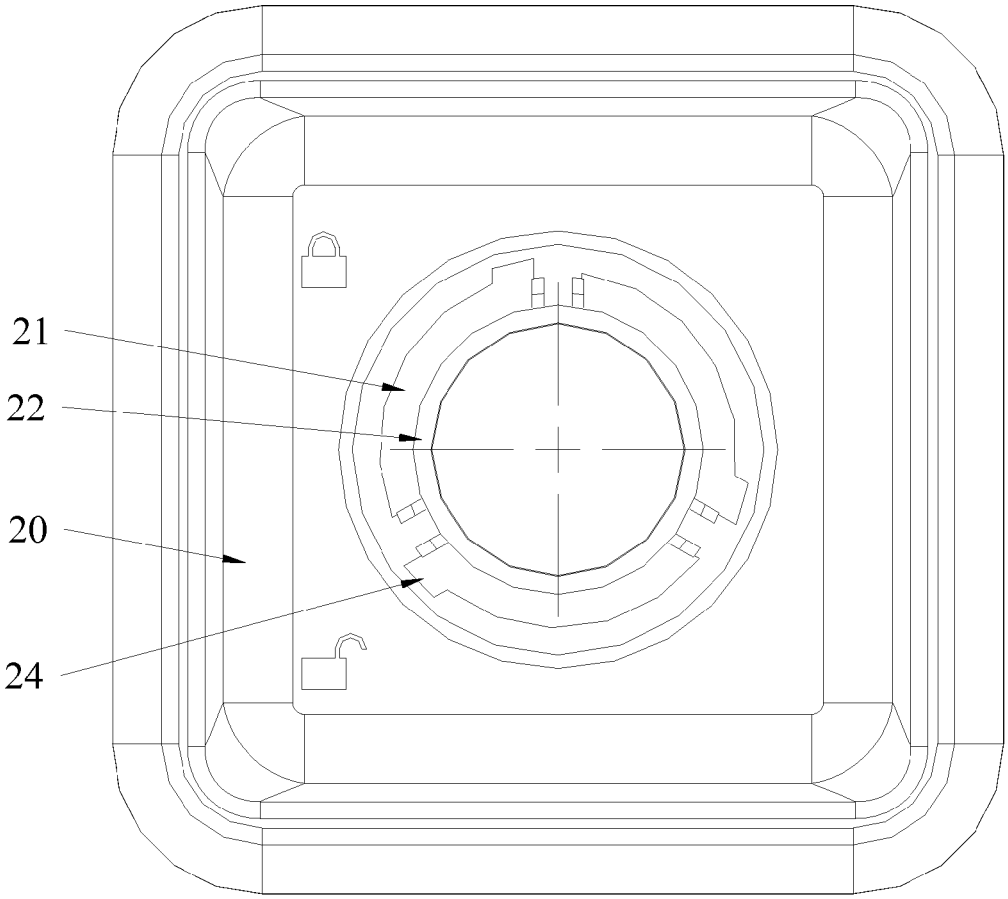
FIG. 7 is a top view of the lid as in FIG. 6*a*.

As shown in FIGS. 1, 1*a*, 1*b*, 2, 3, 4, 4*a*, 4*b*, 5, 5*a*, 6, 6*a* and 7, in the preferred embodiments of the present invention, the rotary airtight container comprises a body 10, a lid 20, a cover plate 30, a lifting mechanism and a cone-shaped seal ring 1. The body 10 has an opening 12, and the lid 20 covers the opening 12. The cover plate 30 is arranged under the lid 20. The cover plate 30 is driven by the lifting mechanism and is capable of rising and lowering relative to the lid 20. The cone-shaped seal ring 1 is positioned all around the cover plate 30. A tapered annular interface is provided on the bottom of the lid 20 to match with the seal ring 1.

In detail, location notches 31 are provided all around the cover plate 30. One end 1*a* of the cone-shaped seal ring 1 is inserted into the notches 31 and the other end 1*b* is tightly wedged against the tapered annular interface. When the lifting mechanism drives the cover plate 30 to make the cover plate 30 slide up or down relative to the lid 20, the seal ring 1 is then driven by the cover plate 30 to slide up or down along the tapered annular interface, thus filling in the gap between the tapered annular interface and the opening 12 to seal the interface between the lid 20 and the body 10, or depart from the gap between the tapered annular interface and the opening 12 to unseal the interface between the lid 20 and the body 10.

In the preferred embodiment, the lifting mechanism includes a swivel nut 40 and a locking cover 50. The nut 40 engages the cover plate 30 and drives the cover plate 30 to move up and down relative to the nut 40 by rotating the nut 40. The locking cover 50 can locate the swivel nut 40 on the cover plate 30 and when the nut 40 drives the cover plate 30 to move up and down, it also drives the cover plate 30 to move up and down relative to the lid 20.

Specifically, a cartridge 32 that extends upward is provided at the center of the cover plate 30, and a slot 21 is provided at the center of the lid 20 for the cartridge 32 to pass through. The swivel nut 40 is sleeved on parts of the cartridge 32 that upwardly pass through the slot 21. A first spiral slideway 41 and a first sliding column 33 for driving the cover plate 30 to lift up relative to the lid 20 is provided between the outer wall of the cartridge 32 and inner wall of the swivel nut 40, and a second spiral slideway 34 and a second sliding column 42 for driving the cover plate 30 to move down relative to the lid 20 is also provided there. Particularly, the first spiral slideway 41 and second sliding column 42 are located on the inner wall of the swivel nut 40, and the second spiral slideway 34 and first sliding column 33 are located on the outer wall of the cartridge 32.

When swivel nut 40 rotates upwardly along the first spiral slideway 41, the first sliding column 33 of the cartridge 32 will slides along the first spiral slideway 41, and the first sliding column 33 moves up relative to the first spiral slideway 41, which makes the cartridge 32 slides upwardly relative to the swivel nut 40, therefore the cover plate 30 moves up relative to the swivel nut 40. As the swivel nut 40 is located on the lid 20, the swivel nut 40 then cannot move vertically relative to the lid 20. When the cover plate 30 moves up relative to the lid 20, the cone-shaped seal ring 1 is inserted into the vacant space between the lid 20 and the body 10 thereby providing a seal between them.

When swivel nut 40 rotates in the opposite direction, that is, it rotates upwardly along the second spiral slideway 34, the second sliding column 42 of the swivel nut 40 will slides along the second spiral slideway 34, and the second sliding column 42 moves up relative to the second spiral slideway 34, which makes the swivel nut 40 slides upwardly relative to the cartridge 32, therefore the swivel nut 40 moves up relative to the cover plate 30. As the swivel nut 40 is located on the lid 20, when the cover plate 30 moves down relative to the lid 20, the cover plate 30 is pressed down, thus the cone-shaped seal ring 1 is separated from the vacant space between the lid 20 and the body 10, and the seal between them is broken.

For ease of installation, it is better to provide a first quit gap 43 on the first slideway 41 of the swivel nut 40 for disconnection of the first sliding column 33. When the swivel nut 40 need to be sleeved on the parts of the cartridge 32 that upwardly pass through the slot 21, just aim the first quit gap 43 at the first sliding column 33, and the first sliding column 33 then can slide into the inner side of the swivel nut 40 and engages the first slideway 41.

Also for ease of installation, it is better to provide a second quit gap 24 on the slot 21 of the lid 20 for disconnection of the first sliding column 33. When the cartridge 32 needs to be downwardly pass through the slot 21 of the lid 20, just aim the second quit gap 24 at the first sliding column 33, and the first sliding column 33 then can pass through the lid 20 to engage the swivel nut 40.

In order to locate the swivel nut 40 on the lid 20, it is preferred to provide a positioning sleeve 22 on the center of the lid 20. The swivel nut 40 sleeves on the positioning sleeve 22, and a first positioning step 44 and second positioning step 51 are provided between the locking cover 50 and the swivel nut 40 to prevent horizontal relative movement between the locking cover 50 and the swivel nut 40. A positioning jack catch 52 that inserts into the positioning sleeve 22 and locks on the lower end surface of the sleeve 22 is provided on the bottom of the locking cover 50. Specifically, the first positioning step 44 is provided on the locking cover 50, and the second positioning step 51 is provided on the top end of the swivel nut 40. As the locking cover 50 inserts into the swivel nut 40, the first positioning step 44 and the second positioning step 51 cooperate with each other to prevent horizontal relative movement of the swivel nut 40 and the locking cover 50. With the cooperation of the positioning jack catch 52 with the lower end of the positioning sleeve 22, that is, the positioning jack catch 52 lock on the lower end of the positioning sleeve 22, the vertical movement between the locking cover 50 and the positioning sleeve 22 is restricted, thus the swivel nut 40 is located between the locking cover 50 and the lid 20, and the swivel nut 40 can only rotate with respective to the lid but cannot vertically move with respect to it.

In the preferred embodiment, preferably a third positioning step 23 is provided on the lid 20 for engaging with the lower end of the swivel nut 40. As the lower end of the swivel nut 40 locks into the third positioning step 23, the horizontal movement between the lid 20 and swivel nut 40 is restricted. Therefore, the swivel nut 40 be located on the lid 20, resulting in a more effective and easy operation.

In the preferred embodiment, it also can provide a positioning column 51*a* and a positioning gap 44*a* between the first positioning step 44 and second positioning step 51 for preventing relative rotation between the locking cover 50 and the swivel nut 40, so the swivel nut 40 is reliably located between the locking cover 50 and lid 20.

In another preferred embodiment, the lifting mechanism is a little different in that it includes a lift rod and a twist grip. The lift rod is rotatably provided on the lid, one end of the lift rod rotatably connected on the upper side of the lid and the other end fixed on the twist grip. When lifting the twist grip, the cover plate is driven to lift. When pressing the grip, the cover plate will move down. In order to position the cover plate on different positions (sealing position and contacting seal position), a dummy club having at least two location notches with different depth on the lid. With the cooperation of the location notches and twist grip, the cover plate can is located on different heights.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A rotary airtight container comprising:

a body having an opening and an inner wall;

a lid that covers said opening of said body, said lid having an underside extension defining a circumference;

a cover plate having an upwardly extending wall that nests concentrically within, abutting and slidably engages said underside extension of said lid, said upwardly extending wall having a notch;

a lifting mechanism for driving said cover plate to slidably move with respect to said lid, said lifting mechanism comprising a swivel nut for engaging said cover plate to drive said cover plate to lift, and a locking cover for locating said swivel nut on said cover plate;

a cone-shaped seal ring having a first end and a second end, said first end being positioned around said circumference of said lid, and said second end being positioned in said notch of said upwardly extending wall of said cover plate; and a tapered annular interface on said underside extension of said lid cooperatively engages said first end of said seal ring against said inner wall of said body to seal said opening of said body;

wherein said lid having a positioning sleeve on a center of said lid, said swivel nut being sleeved outside said positioning sleeve, between said locking cover and said swivel nut being a first positioning step and a second positioning step for preventing horizontal relative movement of said locking cover and said swivel nut, said locking cover having a bottom, said bottom of said locking cover having a positioning jack catch inserted into said positioning sleeve and locked on a lower end surface of said sleeve.

2. The rotary airtight container as in claim 1, wherein said lifting mechanism further comprises:

a lift rod rotatably provided on said lid; and a twist grip fixed on a top portion of said lift rod, a lower end of said lift rod being rotatably connected with said cover plate;

wherein at least two location notches with different depth that match with said twist grip are provided on said lid.

3. The rotary airtight container as in claim 1, wherein said cover plate comprises a cartridge extending upwards at a center of said cover plate, said lid having a slot at said center of said lid for said cartridge to pass through, said cartridge having an outer wall and said swivel nut having an inner wall, said swivel nut being sleeved over said outer wall of said cartridge; between said outer wall of said cartridge and said inner wall of said swivel nut being a first spiral slideway and a first sliding column for driving said lid to lift, and between said outer wall of said cartridge and said inner wall of said swivel nut being a second spiral slideway and a second sliding column for driving the lid to move down.

4. The rotary airtight container as in claim 3, wherein said first spiral slideway and said second sliding column are located on said inner wall of said swivel nut; said second spiral slideway and said first sliding column being located on said outer wall of said cartridge.

5. The rotary airtight container as in claim 3, wherein said first slideway of said swivel nut having a first quit gap for disconnection of said first sliding column.

6. The rotary airtight container as in claim 3, wherein said slot of said lid having a second quit gap for disconnection of said first sliding column.

7. The rotary airtight container as in claim 3, wherein said lid having a third positioning step for engaging with a lower end of said swivel nut.

8. The rotary airtight container as in claim 7, wherein between said first positioning step and said second positioning step is a positioning column and a positioning gap for preventing relative rotation of said locking cover and said swivel nut.

* * * * *